United States Patent [19]

Scharer

[11] Patent Number: 4,613,266

[45] Date of Patent: Sep. 23, 1986

[54] GUIDE APPARATUS FOR USE WITH PUNCHING AND BINDING MACHINES

[75] Inventor: Roger M. Scharer, Des Plaines, Ill.

[73] Assignee: General Binding Corporation, Northbrook, Ill.

[21] Appl. No.: 795,078

[22] Filed: Nov. 5, 1985

[51] Int. Cl.[4] ..... B42B 5/10; B26D 5/08

[52] U.S. Cl. ..... 412/40; 83/622

[58] Field of Search ..... 412/16, 40; 83/147, 83/622, 618, 668; 33/143 LU, 143 R, 169 B

[56] References Cited

U.S. PATENT DOCUMENTS

| | | | |
|---|---|---|---|
| 429,087 | 5/1890 | Dickens | 33/143 |
| 2,898,613 | 8/1959 | Frederick | 412/40 |
| 2,985,052 | 5/1961 | Mentzer et al. | 83/618 |
| 3,060,780 | 10/1962 | Stuckens | 412/40 |
| 3,122,761 | 3/1964 | Bouvier | 412/40 |
| 3,125,887 | 3/1964 | Bouvier et al. | 412/40 |
| 3,227,023 | 1/1966 | Bouvier | 83/622 |
| 3,793,660 | 2/1974 | Sims | 412/40 |

*Primary Examiner*—Paul A. Bell

*Assistant Examiner*—Paul Heyrana

*Attorney, Agent, or Firm*—Hill, Van Santen, Steadman & Simpson

[57] ABSTRACT

There is disclosed herein a punching and binding machine which includes a frame, a laterally-extending row of punch means carried on the frame for guiding movement with respect to the frame and for punching binding apertures. A cover is provided for covering the frame and includes a forwardly extending table generally aligned with the punch for supporting materials to be punched. A guide is mounted to the table for securement at a position to said table. The guide includes at least one surface that in the secured position is selectively movable between a paper engaging position and a cover engaging position, each of these positions being generally transverse to the row of punches. The cover engaging position is laterally and outwardly offset of the paper engaging position. Thus an oversized cover punched using the guide in the cover engaging position with overlay edges of paper punched using the guide means in the paper engaging position.

11 Claims, 11 Drawing Figures

FIG. 1
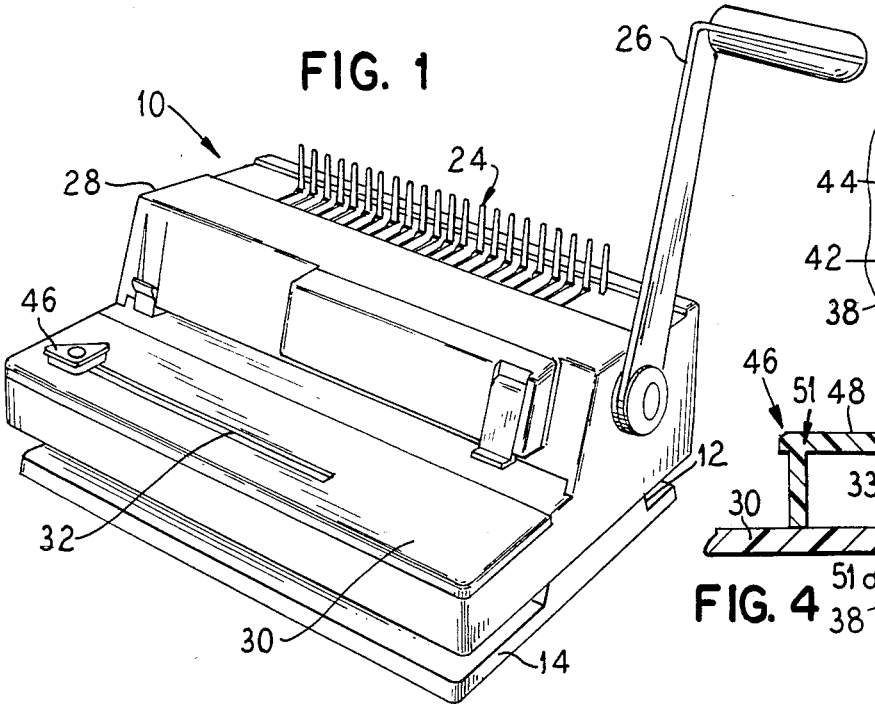
FIG. 5
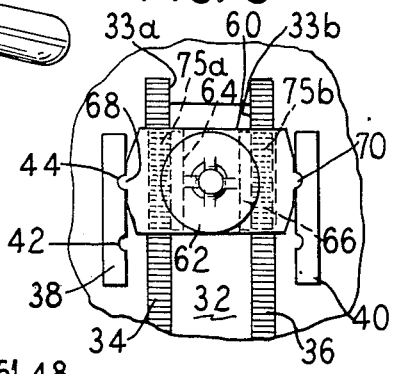
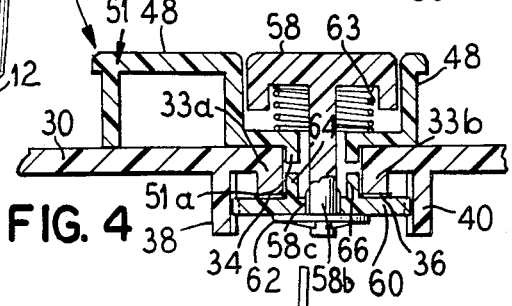
FIG. 4
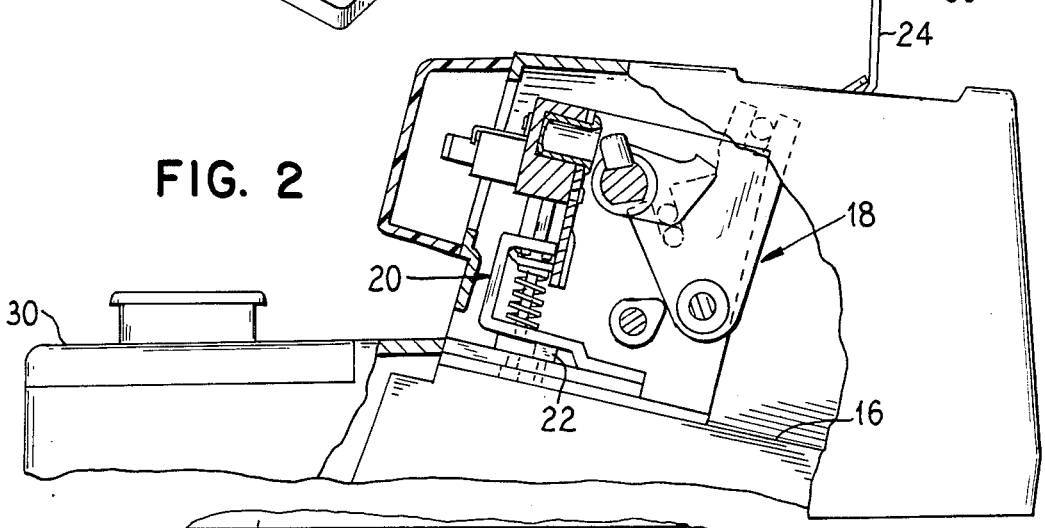
FIG. 2
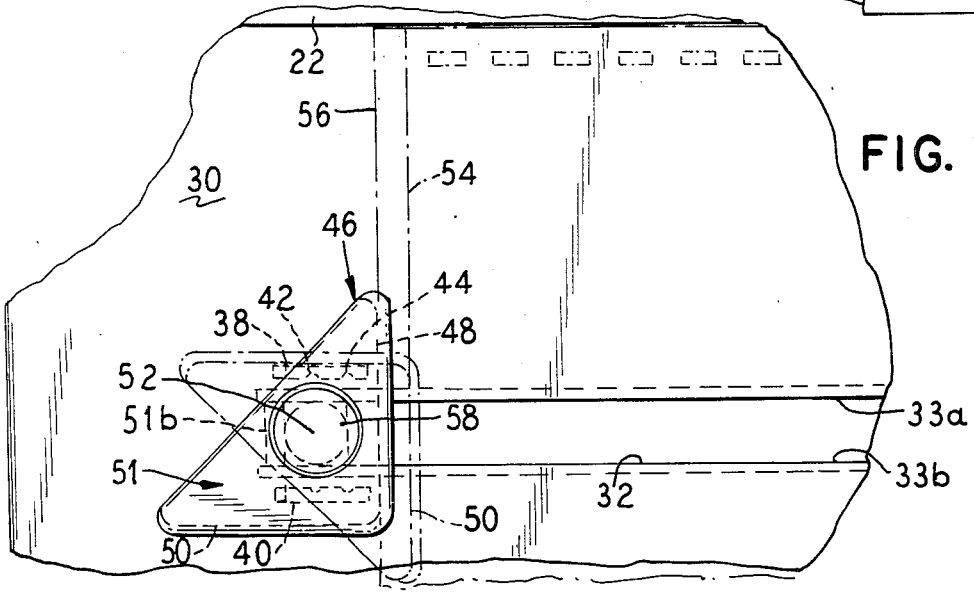
FIG. 3

FIG. 6
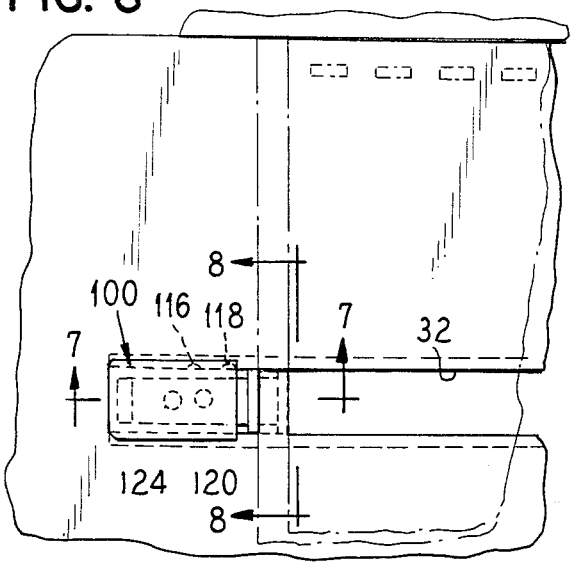
FIG. 8
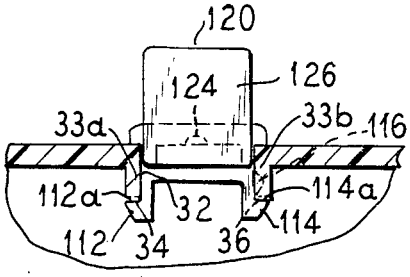
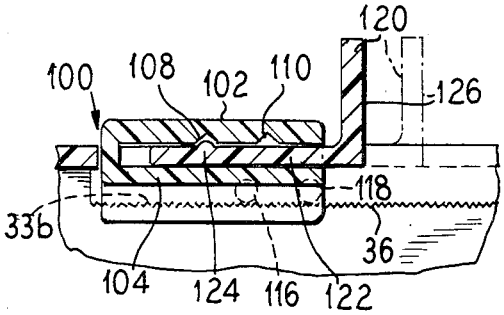
FIG. 7
FIG. 9
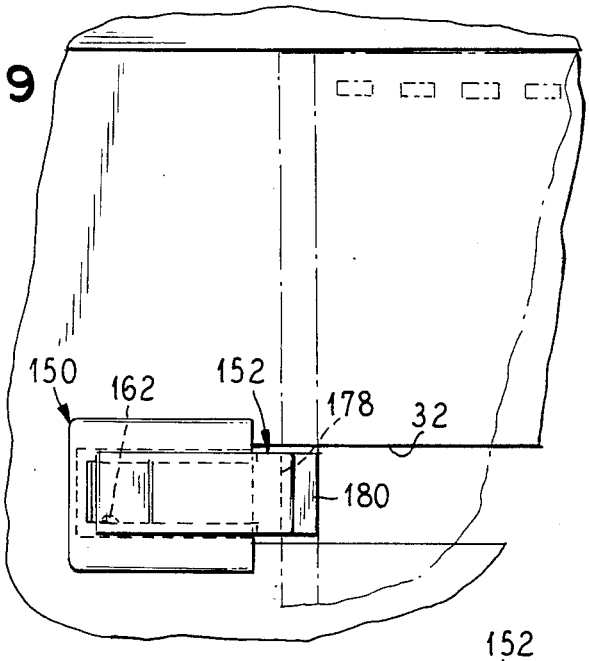
FIG. 11
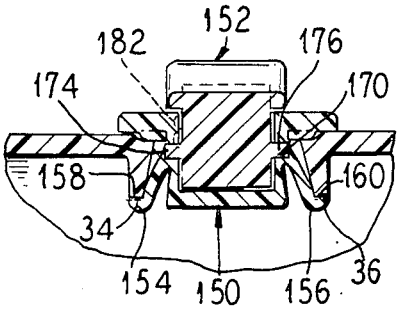
FIG. 10
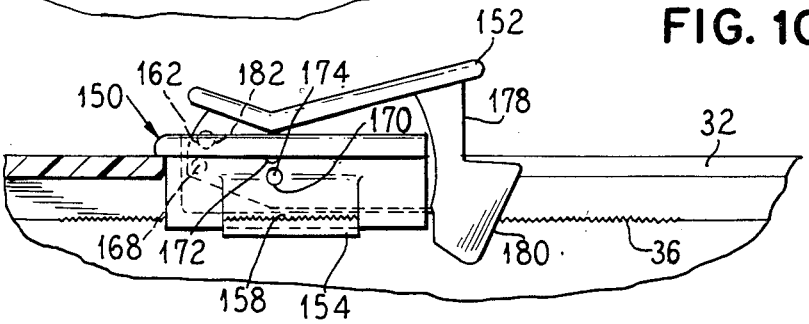

GUIDE APPARATUS FOR USE WITH PUNCHING AND BINDING MACHINES

BACKGROUND OF THE INVENTION

This invention relates to book binding machines of the type having both a punching action and a binding action, and more particularly, to a guide apparatus for use therewith.

In such binding operations a sheaf of paper having text material thereon is bound between front and back covers with a spiral binder so as to form a book, chart or the like. Typically, a guide is provided for guiding the paper and the covers into the punches of the machine where binding apertures are formed along an edge of the paper. Usually binding apertures are punched along the left-side edge of the papers and covers and the guide engages the bottom edges of the papers and covers (which are at right angles to the left-side edge) so as to assure binding registry of successively punched papers or covers.

In some situations cover stock is provided which is larger than the paper so as to overlay and protect edges of the paper. In such situations, it is desirable that the covers extend beyond the top, bottom and right side edges of the paper, while for binding purposes it is desirable that the left-side edge of the cover be flush with the left-side edge of the paper or text being bound.

Prior guides satisfactorily assure binding of equal-sized paper and cover stock and flush positioning of paper stock and cover stock along the bound or punched edges. See U.S. Pat. Nos. 3,122,761; 3,125,887; 3,227,023; and 3,793,660 for examples of such machines and guides.

However, these machines are not efficient for positioning and guiding oversized cover stock for punching that will assure that the cover stock will overlay (i.e., extend beyond) the top, bottom and unbound side paper edges and be flush with the bound side edge.

For example, in some situations the operator, in order to assure an overlying relationship, will first use the guide for punching the paper or text and then reposition the guide several times until the cover is punched for the appropriate overlying relationship.

It is an object of this invention to provide a guide apparatus which can be used in punching both paper and oversized cover stock so as to assure an overlying relationship.

It is another object of this invention to provide a guide apparatus which eliminates the need for repositioning in order to punch oversized cover stock so as to provide the overlying relationship.

These and other objects of this invention will become apparent from the following description and appended claims.

SUMMARY OF THE INVENTION

There is disclosed herein a guide apparatus for use with a binding machine and for selective use with both paper or text material (i.e., the body of a book to be bound) and oversized cover stock so as to assure an overlying relationship. The binding machine includes a laterally-extending row of aperture-forming punches and a table-like support aligned therewith for supporting the paper and cover to be punched. The table includes a slot which is generally parallel to the punches and in which the guide apparatus is mounted for movement and positioning relative to the punches. Detents are provided for selective positioning of the guide apparatus along the slot for use in binding books of predetermined sizes or formats.

The guide apparatus includes a paper engaging surface and a cover engaging surface which are selectable for use. These surfaces when used are aligned at right angles to or transverse to the row of punches. Generally, the bottom edge of the material being punched is positioned against the selected guide surface and a side edge is positioned under the row of punches. The paper engaging surface, when in the operative position, aligns the paper to be punched longitudinally with respect to the punches. The cover engaging surface, when in the operative position, is laterally and outwardly offset from the paper engaging position so as to permit the oversized cover to be punched in registry with the paper and in a manner to assure overlying binding.

Three specific embodiments are shown herein. These are a rotatable guide, a slidable guide, and a rockerstyle guide, all of which function in the manner described above.

BRIEF DESCRIPTION OF THE DRAWINGS

FIG. 1 is a perspective view of the punch and binding machine which incorporates the guide of this invention;

FIG. 2 is a vertical sectional view showing the guide and the punch mechanism;

FIG. 3 is a schematic plan viewing showing a rotatable guide and its positioning relative to the punches;

FIG. 4 is a sectional view of the rotatable guide;

FIG. 5 is a plan view of a retainer used with the rotatable guide;

FIG. 6 is a fragmentary plan view showing the slide-type embodiment for the guide;

FIG. 7 is a vertical sectional view taken along line 7—7 of FIG. 6 and showing the slide mechanism;

FIG. 8 is a vertical sectional view taken along line 8—8 of FIG. 6 of the slide mechanism showing the engagement of the slide mechanism with the machine cover;

FIG. 9 is a fragmentary plan view showing a rocker-style guide;

FIG. 10 is a vertical sectional view taken along line 10—10 of FIG. 9 showing details of the rocker mechanism; and FIG. 11 is a vertical sectional view taken along line 11—11 of FIG. 9 showing an end of the slide and its engagement with the machine cover.

DESCRIPTION OF THE PREFERRED EMBODIMENT

Referring now to FIG. 1, a book binding machine 10 is shown, which includes a frame 12 having a base 14 and mechanism supporting portion 16. The punch and binding mechanism 18 generally is secured to the base and includes a row of laterally aligned punches, such as 20, for punching the binding apertures. A back plate 22 is provided for engaging and positioning the edge of the paper or cover to be punched relative to the punches. The mechanism also includes a comb 24 for uncurling a spiral binder element to permit punched sheets to be impaled and bound thereby in a known manner. Such elements are shown in U.S. Pat. No. 1,970,285.

In the machine shown herein, the actuator handle 26 activates the mechanism 18 to depress and retract the punches, such as 20, and to operate the comb assembly 24 for uncurling a binding element. See U.S. Pat. Nos.

3,122,761 and 3,227,063 for a description of the manual operation of such a machine. Furthermore, the punches can be power operated as shown in U.S. Patent No. 3,793,660.

The frame 12 and mechanism 18 are enclosed by a cover 28, which also defines a forwardly extending tablelike support 30, which, in turn, defines a guide slot 32. The guide slot 32 is provided with slot-forming shoulders 33*a* and 33*b*, and gripping teeth are provided along each longitudinal edge of the slot-forming shoulders. The teeth are shown as 34 and 36 in FIG. 4. A pair of depending detent tabs 38 and 40 depend from the underside of the table-like support 30. Each of the detent tabs include a pair of detent depressions such as 42 and 44, which define home or preselected positions for punching of the $8\frac{1}{2}\times 11$ or the DIN A-4 formats. The outer detents such as 42 are for use in connection with the $8\frac{1}{2}\times 11$ format, and the inner detents such as 44 are for use with the DIN A-4 format.

In the embodiments shown in FIGS. 1, 3 and 4, a rotatable guide member 46 is provided for movement along the slot 32. The guide member includes a housing 51 having a cover engaging surface 48 and a paper engaging surface 50. The housing 51 is rotatable about the substantially vertical axis 52, which is offset with respect to the cover engaging surface 48 and paper engaging surface 50. That is, the axis 52 is radially closer to the cover engaging surface 48 than it is to the paper engaging surface 50 so as to define an offset between the two positions, which permits the housing to be positioned for punching paper as indicated by line 54 and/or punching the overlying cover as indicated by line 56. In other words, when in the active positions, the cover engaging surface is laterally and outwardly positioned of the paper engaging surface. This is seen in FIG. 3 by the difference in positions between the two surfaces as indicated by the solid and phantom lines 54 and 56.

The guide housing 51 includes a circular recess for receiving a locking and release button assembly 58. The recess includes shoulders 51*a* for engaging and guiding movement in the slot and defines a square-shaped aperture 51*b* for detent cooperation with the slot and the release button 58. The button 58 includes a cap 58*a* having a spring keeper-like section and a stem 58*b*, which extends through the aperture 51*b* and the slot 32. The stem is provided with retaining shoulders 58*c* and a retainer and detent plate 60 is mounted on the shaft, engages shoulders 58*c* and is held in place by a nut or spring clip 62.

The squared shoulders 51*a* form a positioning detent whereby the housing 51 may be raised against a biasing compression spring 63 and rotated 90° so as to appropriately and selectively position either the paper engaging surface or the cover engaging surface. In other words, the shoulders 51*a* by being square cooperate with the slot 32 to provide detents for holding the guide in either the paper or cover engaging position.

The retainer plate 60 includes a pair of alignment shoulders 64 and 66, which slide in the slot 32 and engage the slot-forming shoulders 33*a* and 33*b*, a pair of outer detents 68 and 70, which engage detents such as 44 or 42 in the depending detent tabs so as to define the pre-formatted positions; and gripping teeth 75*a* and 75*b* for engaging the gripping teeth 34 and 36.

In order to punch paper and covers of a size other than $8\frac{1}{2}\times 11$ or DIN A-4, the release button may be pushed downwardly and the guide moved along the slot 32 to the desired position and the release button then released. Then the gripping teeth, such as 34, 36, 75*a* and 75*b* cooperate with the retainer member 60 under the action of the biasing spring 63 so as to hold the guide in a desired position by action of the gripping teeth and without the use of the detents. It should be noted that the retainer is prevented from rotating by the shoulders 64 and 66 remaining in engagement with the slot 32 and the slot-forming shoulders 33*a* and 33*b*.

Turning now to the slide-type guide and referring to FIGS. 6–8, the slide includes a U-shaped housing 100 which fits within the slot 32 and includes upper and lower walls 102 and 104 and an outer wall or bight portion 106. The upper wall is provided with two detent depressions 108 and 110, which cooperate in defining cover and paper engaging positions and a pair of depending and outwardly biased legs 112 and 114 which engage slot-forming shoulders 33*a* and 33*b* and also define guide gripping teeth 112*a* 114*a* along the edges thereof. The guide gripping teeth 112*a* and 114*a* cooperate with the gripping teeth 34 and 36 provided on the slot defining shoulders 33*a* and 33*b*. Detent protrusions such as 116 are provided on the side of the housing to cooperate with detent depressions such as 118 provided on the side of the slot 32 to define the $8\frac{1}{2}\times 11$ and DIN A-4 format positions.

An L-shaped slide member 120 is provided for movement within the housing 100. The slide member includes a first or horizontal leg 122 which slides within the housing and carries a detent protrusion 124 which cooperates with the detent depressions 108 and 110 to define the cover engaging and surface engaging positions. The second or vertical leg 126 engages the paper or cover which positions the paper or cover with respect to the punches. As shown in FIG. 6 in the retracted position, the L-shaped slide member defines the cover engaging position, and in the extended but laterally and inwardly offset position, defines the paper engaging position. Thus in principal the operation of the sliding guide is similar to that of the rotary guide in defining two offset positions—one for punching paper and one for punching the cover to assure the overlying relationship. In the event other than $8\frac{1}{2}\times 11$ or DIN A-4 format is to be punched, the slide is moved in the slot to the desired position, and the gripping teeth on the housing shoulders and the slot-forming shoulders engage so as to securely position the guide member.

The rocker style embodiment is shown in FIGS. 9 through 11, inclusive. In the rocker style embodiment, there is provided a channel-like housing 150 which slides in the slot 32 and carries a paper and cover positioning rocker 152. The housing also includes a pair of outwardly biased, slot-forming, shoulder-engaging wing-like members 154 and 156. The wings are molded to the sides of the housing 150 and provide an outward spring bias and define gripping teeth 158 and 160 for engaging the gripping teeth 34 and 36 on the slot-defining shoulders. A pair of rocker detent depressions 162 and 168 are provided on the inner surface of the housing as well as pivot receiving apertures such as 170. Housing positioning detents, such as 172, are provided on the housing shoulder and engage detent depressions along the cover surface adjacent slot 32. These detents define the $8\frac{1}{2}\times 11$ and DIN A-4 format positions. The rocker assembly 152 includes pivot pins such as 174 and 176 for pivotally engaging the pivot pin openings such as 170. The inward end of the rocker includes an upper cover engaging surface 178 and a lower paper engaging surface 180. The outer end of the rocker includes detent protrusion such as 182 for cooperation with the detent depressions 162 and 168. When the inner end of the rocker is pushed downwardly, the detents engage so as to position the cover engaging surface 178 in alignment for engagement by a cover. When the outer surface of the rocker is pushed downwardly, the inner end of the rocker moves upwardly and the paper engaging surface 180 is exposed and aligned for engaging paper to be punched. Again, the cover engaging surface 178 and paper engaging surface 180 are laterally offset from one another so as to permit the aligned punching of oversized paper.

As in the other embodiments, the housing may be positioned for either an $8\frac{1}{2}\times 11$ or DIN A-4 paper or may be moved to any other position, in which case the gripping teeth 34, 36, 158 and 160 engage under the action of the wing members 154 and 156 to hold the housing in the new position.

Although the invention has been described with respect to preferred embodiments, it is not to be so limited as changes and modifications can be made which are within the full intended scope of the invention as defined by the appended claims.

I claim as my invention:

1. A punching and binding machine which includes:

a frame;

a laterally-extending row of punch means carried on the frame for movement with respect to the frame and for punching binding apertures;

cover means carried by said frame which define table means generally aligned with said punch means; and guide means mounted on said table means for securement in a position to said table means, said guide means having at least one surface that in said secured position is selectively movable between a paper engaging position and a cover engaging position, each of said positions being generally transverse to said row of punch means, and said cover engaging position being laterally and outwardly offset from said paper engaging position;

so that an oversized cover punched using said guide means in the cover engaging position will overlay the edges of paper punched using said guide means in the paper engaging position with all binding apertures being in registry.

2. A machine as in claim 1, wherein said guide means is laterally movable along said table means parallel to the row of punch means.

3. A machine as in claim 2, wherein detent means are provided on said table means and said guide means for positioning said guide means at predetermined positions relative to said row of punch means.

4. A machine as in claim 3, wherein said table means defines a laterally extending slot for cooperation with said guide in its movement, and gripping teeth means are associated with said cover adjacent said slot and with said guide for cooperation in securing said guide means to said table means along said slot.

5. A machine as in claim 1, wherein said guide means is rotatably mounted to said table means and includes paper engaging side means and cover engaging side means disposed at right angles to each other and selectively movable to said paper engaging position and cover engaging position, respectively, said member being rotatable about an axis normal to said table means and substantially parallel to said side means, said axis being positioned radially closer to the cover engaging side means than the paper engaging side means.

6. A machine as in claim 5, wherein detent means are provided in association with said table means and guide means for selectively securing said paper engaging side means in said paper engaging position or said cover engaging side means in said cover engaging position.

7. A machine as in claim 1, wherein said guide means includes a housing mounted to said table means and a positioning slide carried by said housing, said slide having an engagement surface and being movable so that said engagement surface is selectively positionable in said paper engaging position or said cover engaging position.

8. A machine as in claim 7, wherein said slide and housing further include detent means for selectively securing said slide in either said cover engaging position or said paper engaging position.

9. A machine as in claim 1, wherein said guide means is of a rocker style and includes a housing mounted to said table means and a positioning rocker element pivotally mounted in said housing, said rocker element having an inwardly positioned edge defining a paper engaging surface and a cover engaging surface, said surfaces being selectively movable to said paper engaging position or said cover engaging position.

10. A machine as in claim 9, wherein the cover engaging surface is positioned on an upper portion of said edge and the paper engaging surface on a lower portion of said edge, so that when the inner end of the rocker element is in an upper position, the cover engaging surface is aligned with the table surface, and when the rocker element is in a lower position, the paper engaging surface is aligned with the table engaging surface.

11. A machine as in claim 10, wherein detent means are provided for association with said rocker element and housing for selectively positioning said rocker element in either the paper engaging position or the cover engaging position.

* * * * *